US009306266B2

(12) United States Patent
Valkonen et al.

(10) Patent No.: US 9,306,266 B2
(45) Date of Patent: Apr. 5, 2016

(54) MULTI-BAND ANTENNA FOR WIRELESS COMMUNICATION

(71) Applicant: Aalto University Foundation, Aalto (FI)

(72) Inventors: Risto Valkonen, Espoo (FI); Janne Ilvonen, Lohja (FI)

(73) Assignee: AALTO UNIVERSITY FOUNDATION, Aalto (FI)

( * ) Notice: Subject to any disclaimer, the term of this patent is extended or adjusted under 35 U.S.C. 154(b) by 488 days.

(21) Appl. No.: 13/624,202

(22) Filed: Sep. 21, 2012

(65) Prior Publication Data

US 2014/0085160 A1 Mar. 27, 2014

(51) Int. Cl.

| | |
|---|---|
| ***H01Q 1/50*** | (2006.01) |
| ***H01Q 1/24*** | (2006.01) |
| ***H01Q 9/42*** | (2006.01) |
| ***H01Q 5/335*** | (2015.01) |
| ***H01Q 5/35*** | (2015.01) |

(52) U.S. Cl.

CPC ..... *H01Q 1/243* (2013.01); *H01Q 5/335* (2015.01); *H01Q 5/35* (2015.01); *H01Q 9/42* (2013.01)

(58) Field of Classification Search

CPC ..... H01Q 1/38; H01Q 9/42; H01Q 5/0003; H01Q 1/243; H03H 7/38

USPC ..... 343/860, 700 MS, 702

See application file for complete search history.

(56) References Cited

U.S. PATENT DOCUMENTS

| | | | | |
|---|---|---|---|---|
| 6,483,464 | B2 * | 11/2002 | Rawnick et al. | 343/700 MS |
| 6,639,558 | B2 * | 10/2003 | Kellerman et al. | 343/700 MS |
| 7,528,780 | B2 * | 5/2009 | Thiam et al. | 343/700 MS |
| 8,325,093 | B2 * | 12/2012 | Holland et al. | 343/700 MS |
| 2007/0279289 | A1 * | 12/2007 | Baliarda et al. | 343/700 MS |
| 2008/0174508 | A1 * | 7/2008 | Iwai et al. | 343/850 |
| 2010/0099367 | A1 * | 4/2010 | Shamim et al. | 455/95 |

* cited by examiner

*Primary Examiner* — Huedung Mancuso
(74) *Attorney, Agent, or Firm* — Young & Thompson

(57) ABSTRACT

A multi-band antenna includes a ground plane, a single antenna element, a frequency multiplexing circuit and at least two feeding strips coupled between the frequency multiplexing circuit and the single antenna element. Furthermore, the feeding of the antenna is arranged by one or more feeding points arranged between the ground plane and the frequency multiplexing circuit. According to first implementation one feeding point is arranged for at least two antenna branches. The signal fed into the feeding point is multiplexed by the multiplexing circuit to the antenna branches. According to at least one other implementation a dedicated feeding point is arranged for each of the antenna branches. At the same time the isolation of the frequencies between the different branches is arranged. This can be achieved e.g. by a multiplexing circuit. Moreover, impedance of the antenna branches can be matched with matching circuitry.

22 Claims, 5 Drawing Sheets

MULTI-BAND ANTENNA FOR WIRELESS COMMUNICATION

TECHNICAL FIELD

The invention concerns in general the technical field of radio antennas. Especially the invention concerns multi-band antenna and matching circuits for the antenna for use e.g. in a mobile communication terminal.

BACKGROUND OF THE INVENTION

Current wireless communication systems utilize several different radio communication standards and operate at many different frequency bands. In this fractured service environment, mobile terminals operating in multiple systems and frequency bands offer a better service coverage than single band and single-system terminals. One example of a multi-band communication terminal is a mobile terminal operating for example at four GSM bands, namely GSM850 (824-894 MHz), GSM900 (880-960 MHz), GSM1800 (1710-1880 MHz), GSM1900 (1850-1990 MHz) and further at three WCDMA bands, namely WCDMA I (1920-2170 MHz), WCDMA II (1850-1990 MHz) and WCDMA V (824-894 MHz).

In order to enable the utilization of multiple frequency bands by a mobile terminal the reception and transmission of the radio signals need to be arranged. An essential element for an operation in multiple frequency bands is an antenna and necessary circuits, such as matching circuits, thereto residing in the mobile terminal. More specifically, a compact multi-band antenna configuration with good performance is needed to realize the communication of mobile terminals with multiple bands. Currently, one approach is that mobile terminals comprise multiple antennas which are dedicated for different frequency bands, e.g. lower and higher frequencies. At the same time as the space for the antennas in the mobile terminal is becoming very limited there is a need to fit more and more antennas inside the terminal, for example to implement mobile antenna diversity.

For example, a prior art multi-band antenna module may include a substrate, first and second coupling elements i.e. antenna elements, and first and second resonant matching circuits. The first coupling element is mounted to the substrate and particularly adapted to couple a first frequency band to a ground plane through a first port. The second coupling element is also mounted to the substrate, and is adapted to couple a second frequency band to a ground plane through a second port. The ground plane may be the same, but is not itself a part of the antenna module. The first resonant matching circuit is coupled to the first port and is disposed on the substrate and has a plurality of components by means of which it is possible to implement a band-pass filter within the first frequency band and to present high impedance at least in the second frequency band. Similarly, the second resonant matching circuit is coupled to the second port and is also disposed on the substrate. The second series matching circuit has a plurality of components that implement a band-pass filter within the second frequency band and to present high impedance at least in the first frequency band.

The outmost challenge is that as the number of required operating frequency bands is increasing, it is very challenging to cover all the required bandwidths with the prior art antenna solutions. The drawback of the prior art antenna solutions according to one approach is that there is a need for a separate antenna element i.e. a coupling element for each of the frequency band. Alternatively, according to another prior art solution one antenna element, typically self-resonant antenna element, can be applied for lower and higher frequencies but in that case the antenna element needs to be big enough in size in order to realize resonances in multiple frequency bands simultaneously. Both of the prior art approaches result a fundamental challenge especially in the area of mobile terminals, because the volume reserved for antennas in the mobile terminal is limited. Furthermore, the prior art implementations force one to isolate the coupling elements from each other so that a coupling between the antenna branches can be prevented. Thus, it can be said that one challenge with the prior art antenna solutions is that antennas, with each encompassing separate frequency bands, causes waste of antenna volume, as the available antenna volume cannot be entirely utilized at any given frequency. Due to the physical limitations of electrically small antennas, it is beneficial to be able to utilize the entire antenna volume especially at the lower frequencies of operation. This way the reachable frequency bandwidth is maximal.

SUMMARY OF THE INVENTION

An objective of the invention is to present a multi-band antenna and antenna module for wireless communication. Another objective of the invention is that the multi-band antenna and the antenna module are arranged with a single antenna element.

The objects of the invention are reached by antennas and antenna modules as defined by the respective independent claims.

According to a first aspect, a multi-band antenna is provided, which comprises a ground plane, a single antenna element, a frequency multiplexing circuit, at least two feeding strips coupled between the frequency multiplexing circuit and the single antenna element and at least one feeding point arranged between the ground plane and the frequency multiplexing circuit. The multi-band antenna may further comprise at least one matching circuit, the at least one matching circuit is arranged to be coupled between the frequency multiplexing circuit and at least one feeding strip. Alternatively or in addition, the multi-band antenna may further comprise at least one matching circuit embedded in the frequency multiplexing circuit, the matching circuit providing impedance matching of at least one feeding strip of the at least two feeding strips for a predetermined frequency band. Furthermore, the multi-band antenna may further comprise two matching circuits embedded in the frequency multiplexing circuit, each of the matching circuits providing impedance matching of each of the feeding strips for at least two predetermined frequency bands. The multiplexing circuit as mentioned may be at least one of the following: diplexer, RF switch, isolation implementation. The single antenna element as mentioned may be at least one of the following: Capacitive Coupling Element, Planar inverted-F antenna, Inverted-F antenna, Planar inverted-L antenna, inverted-L antenna, loop antenna, monopole antenna.

Furthermore, the at least one feeding strip may be configured to be located, with respect to the single antenna element and the ground plane, so that a resonant wavemode of the radiating structure formed by the single antenna element and the ground plane at a given frequency is excited and wherein the at least one other feeding strip may be configured to be located, with respect to the single antenna element and the ground plane, so that that resonant wavemode of the radiating structure or non-orthogonal wavemodes with respect to the resonant wavemode at frequencies close to the resonant wavemode frequency are not excited by the at least one other feeding strips.

According to an second aspect, another multi-band antenna is provided, which comprises a ground plane, a single antenna element, a frequency multiplexing circuit and at least two feeding strips wherein dedicated feeding points are arranged for each of the at least two feeding strips, and each of the at least two feeding strips are coupled between the dedicated feeding point arranged for the feeding strip and the single antenna element. Alternatively or in addition, the multi-band antenna may further comprise at least one matching circuit, the at least one matching circuit arranged to be coupled between one dedicated feeding point and a corresponding feeding strip. The at least one matching circuit may be configured to be embedded in the frequency multiplexing circuit. The single antenna element may be at least one of the following: Capacitive Coupling Element, Planar inverted-F antenna, Inverted-F antenna, Planar inverted-L antenna, inverted-L antenna, loop antenna, monopole antenna.

According to a third aspect, a multi-band antenna module is provided, which comprises a substrate, a single antenna element mounted to the substrate, a frequency multiplexing circuit disposed on the substrate, at least two feeding strips disposed on the substrate and coupled between the frequency multiplexing circuit and the single antenna element and at least one signal port arranged to the substrate, providing an interface for at least external ground plane and a signal source, in order to provide signal to and from the antenna element through the frequency multiplexing circuit and the at least two feeding strips. The multi-band antenna module may further comprise at least one matching circuit disposed on the substrate, the at least one matching circuit is arranged to be coupled between the frequency multiplexing circuit and at least one feeding strip. Furthermore, the multi-band antenna module may also comprise at least one matching circuit embedded in the frequency multiplexing circuit and disposed on the substrate, the matching circuit providing impedance matching of at least one feeding strip of the at least two feeding strips for a predetermined frequency band. Further, the multi-band antenna module may comprise two matching circuits embedded in the frequency multiplexing circuit and disposed on the substrate, each of the matching circuits providing impedance matching of each of the feeding strips for at least two predetermined frequency bands. The multiplexing circuit disposed on the substrate may be at least one of the following: diplexer, RF switch, isolation implementation. The single antenna element mounted to the substrate may be at least one of the following: Capacitive Coupling Element, Planar inverted-F antenna, Inverted-F antenna, Planar inverted-L antenna, inverted-L antenna, loop antenna, monopole antenna.

Furthermore, the at least one feeding strip may be configured to be disposed on the substrate, with respect to the single antenna element, so that a resonant wavemode of the radiating structure formed at least partly by the single antenna element at a given frequency is excited and wherein the at least one other feeding strip may be configured to be disposed on the substrate, with respect to the single antenna element, so that that resonant wavemode of the radiating structure or non-orthogonal wavemodes with respect to the resonant wavemode at frequencies close to the resonant wavemode frequency are not excited by the at least one other feeding strips.

According to a fourth aspect, a multi-band antenna module is provided, which comprises a substrate, a single antenna element mounted to the substrate, a frequency multiplexing circuit disposed on the substrate and at least two feeding strips disposed on the substrate wherein dedicated signal ports, providing an interface to an external ground plane and at least one signal source, are arranged to the substrate for each of the at least two feeding strips, and each of the at least two feeding strips are coupled between the dedicated signal port arranged for the feeding strip and the single antenna element. The multi-band antenna module may further comprise at least one matching circuit disposed on the substrate, the at least one matching circuit arranged to be coupled between one dedicated signal port and a corresponding feeding strip. Further, the at least one matching circuit may be configured to be embedded in the frequency multiplexing circuit. The single antenna element mounted to the substrate may be at least one of the following: Capacitive Coupling Element, Planar inverted-F antenna, Inverted-F antenna, Planar inverted-L antenna, inverted-L antenna, loop antenna, monopole antenna.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION AND ITS ADVANTAGEOUS EMBODIMENTS

The multi-band antenna according to the invention may be applied in the field of telecommunications. More specifically, mobile terminals, laptop computers, tablet computers among other similar devices configured to be wirelessly coupled to a telecommunication network may utilize the invention. The invention is not limited to any specific telecommunication technology as such. The antenna may be configured to implement e.g. WLAN, Wi-Fi, GSM, WCDMA, LTE and LTE-Advanced technologies when it comes to respective frequency bands of the wireless technologies. The mentioned wireless technologies are only examples and the invention as such is applicable to any future standards within the limitations originating from the invention.

Generally speaking the invention is based on an idea in which at least two feeding strips are arranged for one antenna element so that the antenna element can be fed through the at least two feeding strips. The at least two feeding strips are related to separate signal paths for at least two different frequency bands and the locations of the feeding strips with respect to the antenna element and the ground plane are selected to optimize the antenna operation bandwidths. The feeding of the antenna is arranged so that at least one feeding point is implemented between the at least two feeding strips and a ground plane of the antenna structure. A feeding point is physically a small gap (port) between RF ground and an excited part of the structure, across which an incident RF voltage is applied.

Figure 1A:
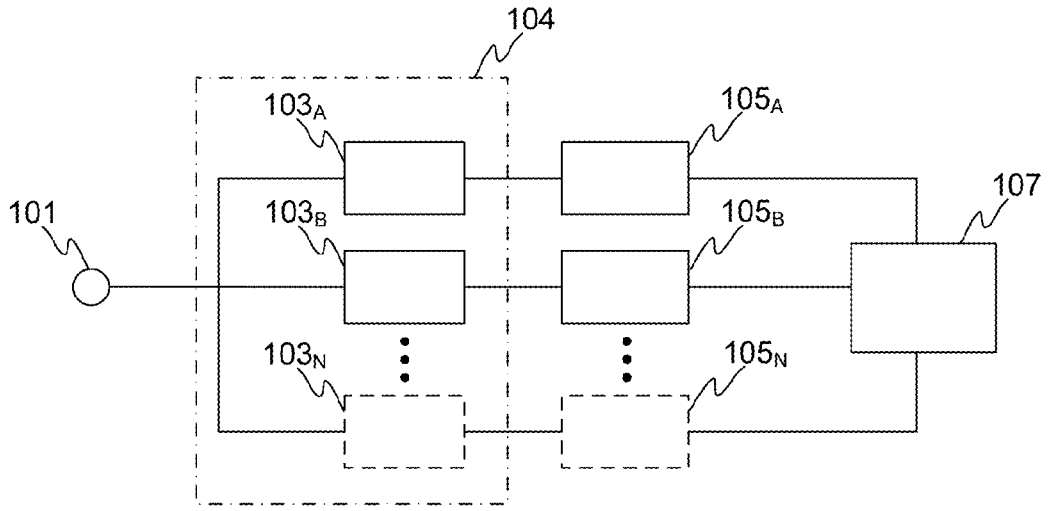
FIGS. 1*a* and 1*b* illustrate antenna structures according to the invention.

An antenna structure with one feeding point is illustrated in FIG. 1*a*. Here the signal fed through the one feeding point 101 is multiplexed to multiple signal paths and taken to matching circuits $\mathbf{103}_A$-$\mathbf{103}_N$. In some special case there is no need for a matching circuit $\mathbf{103}_A$-$\mathbf{103}_N$ in all branches of the antenna structure. The matching circuits $\mathbf{103}_A$-$\mathbf{103}_N$ are to be designed dependent on each other in order to prevent one matching circuit $\mathbf{103}_A$-$\mathbf{103}_N$ to disturb another matching circuit $\mathbf{103}_A$-$\mathbf{103}_N$ so that it affects to the operation of the antenna structure. The matching circuits $\mathbf{103}_A$-$\mathbf{103}_N$ are configured to give response to predetermined frequency bands so that the multiplexing is achieved with the same circuits. This is indicated with a reference 104 in FIG. 1*a*. A feeding strip $\mathbf{105}_A$-$\mathbf{105}_N$ is arranged for each of the antenna branches so that a feeding strip $\mathbf{105}_A$-$\mathbf{105}_N$ is coupled between a corresponding matching circuit $\mathbf{103}_A$-$\mathbf{103}_N$ and an antenna element 107. In the prescribed manner signals with different frequency band can be conveyed to the antenna element for broadcasting.

Figure 1B:
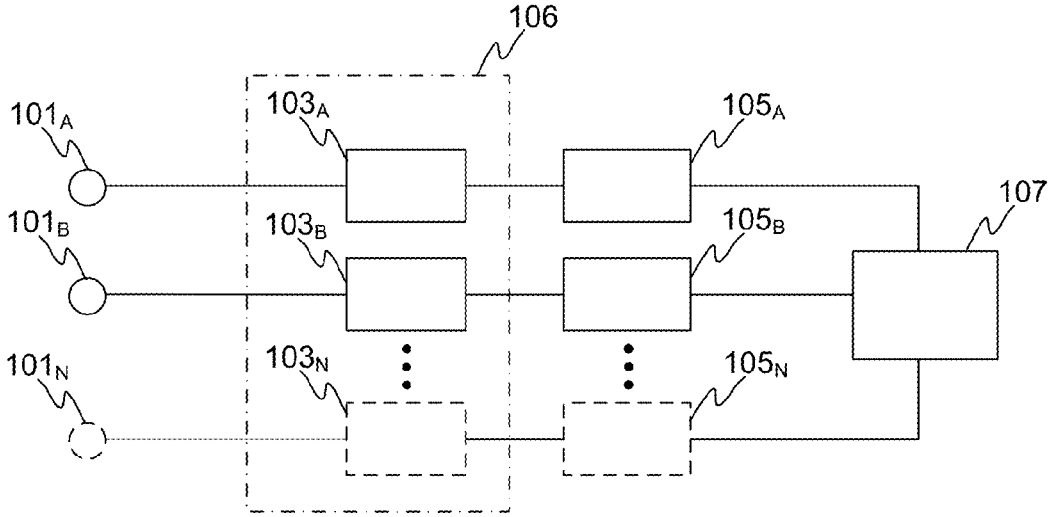

The antenna structure may also comprise more than one feeding points. For example, it is possible to arrange one dedicated feeding point for each of the feeding strips, as depicted in FIG. 1*b*. Matching circuits $\mathbf{103}_A$-$\mathbf{103}_N$ are arranged between each feeding point $\mathbf{101}_A$-$\mathbf{101}_N$ and corresponding feeding strip $\mathbf{105}_A$-$\mathbf{105}_N$. The signals from the feeding points $\mathbf{101}_A$-$\mathbf{101}_N$ through the matching circuits $\mathbf{103}_A$-$\mathbf{103}_N$ and the feeding strips $\mathbf{105}_A$-$\mathbf{105}_N$ are conveyed to the antenna element 107. In this kind of arrangement the matching circuits $\mathbf{103}_A$-$\mathbf{103}_N$ are to be designed so that they also operate as isolation circuits preventing propagation of signals fed to different feeding points into such branches in which the propagation is not desirable. Thus, the isolation as it is gained with the matching circuits $\mathbf{103}_A$-$\mathbf{103}_N$ is indicated with a reference 106 in FIG. 1*b*. However, in order to maintain consistency with the description the isolation circuit 106 in this context is called as multiplexing circuit 104 since the implementation of those circuits are essentially the same.

In order to achieve a full performance of the antenna structure impedances of multiple signal paths implemented at least partly by means of the multiple feeding strips and the antenna element may be matched with impedance matching networks, as described above. The impedance matching may be embedded to the frequency multiplexing with a careful design. In some cases it may be possible that at least some of the antenna branches do not need a matching. In a physical sense the multiplexing circuit, and the matching circuits if that is the case, may be implemented so that the multiplexing circuit is arranged between the feeding strips and the feeding point in the one feeding point solution. The feeding point, in turn, is between the frequency multiplexing circuit and the ground plane i.e. PCB. If the antenna implementation is such that each of the feeding strips comprise an own feeding point, the physical implementation may be such that the matching circuit is arranged between the feeding point and the feeding strip. The arrangement can be implemented in each of the antenna branches i.e. between each feeding point and the corresponding feeding strip if matching is needed. Moreover, according to the invention antenna impedance bandwidth performance can be at least partly adapted to, according to the requirements, by selecting the locations of the at least two feeding strips with respect to the antenna element and the ground plane optimally. Additionally, the shape of the at least two antenna strips may be selected optimally with respect to the desired impedance bandwidth performance.

Figure 2A:
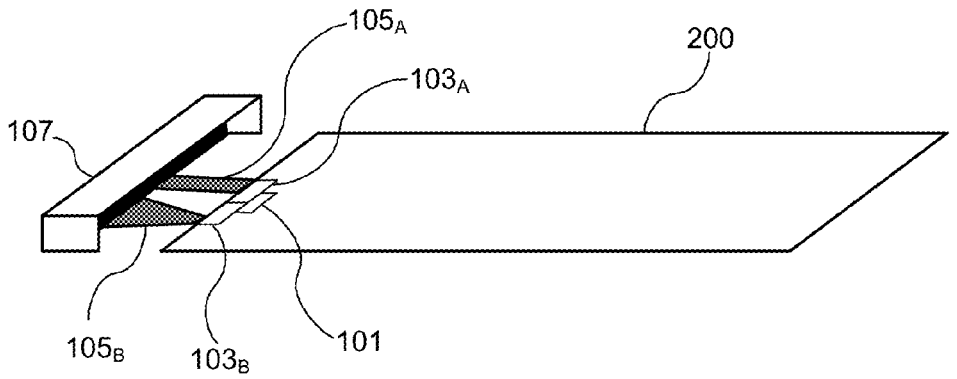
FIGS. 2*a* and 2*b* illustrate antenna structures according to first implementation of the invention.
Figure 2B:
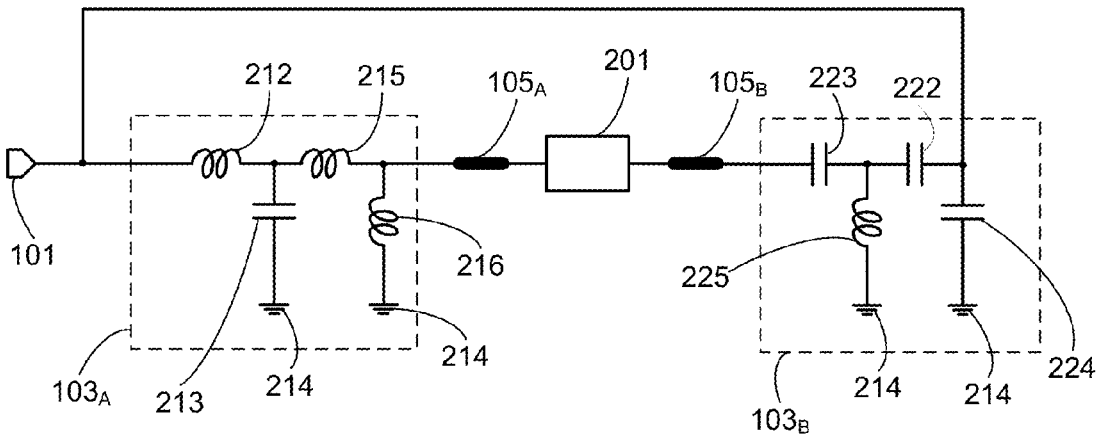

FIG. 2*a* illustrates an implementation according to the invention in which a single feeding point is arranged in the antenna structure. Only two antenna branches are illustrated in FIGS. 2*a* and 2*b* for clarity reasons. The signal path from the feeding point 101 to the antenna element 107, such as capacitive coupling element CCE, is arranged so that the frequency separation, i.e. multiplexing, for each of the signal paths is arranged with matching circuits $\mathbf{103}_A$ and $\mathbf{103}_B$, which are so designed that they perform the frequency separation between the antenna branches. In the single feed arrangement the matching circuits $\mathbf{103}_A$ and $\mathbf{103}_B$ are connected from the antenna element's end to the respective feeding strips $\mathbf{105}_A$ and $\mathbf{105}_B$, and from the feeder end to a common point. Moreover, the matching circuits $\mathbf{103}_A$ and $\mathbf{103}_B$ take also care of the impedance matching for each of the antenna branches. It shall be noted that in this example there exists own matching circuits $\mathbf{103}_A$ and $\mathbf{103}_B$ for each feeding strip $\mathbf{105}_A$ and $\mathbf{105}_B$ belonging to the antenna structure. In practical implementation, the feeding point 101 is arranged as a port between the ground plane 200 and the common end of matching circuits $\mathbf{103}_A$ and $\mathbf{103}_B$, providing an interface for signal excitation. In a single feeding point arrangement it is possible that impedance matching in at least some of the antenna branches may be implemented without any specific matching circuit $\mathbf{103}_A$, $\mathbf{103}_B$, but merely with a design and selection of the antenna element and the feeding strip.

FIG. 2*b* illustrates the implementation of single feeding point case as a simplified electrical drawing. The combination of the antenna element 107 and the ground plane 200, i.e. the radiating structure of the antenna, is illustrated as a load 201. The feeding of the load is arranged through two signal paths each of which comprising a matching circuit $\mathbf{103}_A$, $\mathbf{103}_B$ and a feeding strip $\mathbf{105}_A$, $\mathbf{105}_B$. The single feeding point is illustrated in FIG. 2*b* as a port 101.

In the single feeding point arrangement, as depicted e.g. in FIGS. 2*a* and 2*b*, the fundamental idea is the both signal paths, i.e. antenna branches are configured to separate frequencies so that the antenna can operate on multiple frequency bands. The branches are configured to operate as a diplexer which means that the branches see each other as a path of high reflection at their corresponding operation frequencies. The design of the branches is important in order to obtain the frequency multiplexing to the different antenna branches, but also the impedance matching.

In FIG. 2*b*, an example of the first matching circuit $\mathbf{103}_A$ in FIG. 2*b* on the left to the load 201 is configured for the first signal path, implemented with the first feeding strip $\mathbf{105}_A$ and the second matching circuit $\mathbf{103}_B$ on the right to the load is configured for the second signal path, implemented with the second feeding strip $\mathbf{105}_B$. In the first matching circuit $\mathbf{103}_A$, the antenna input is taken to the load 201 through two coils 212, 215 coupled in series, wherein a capacitor 213 is coupled between the coils 212, 215 and the ground 214. Additionally, a third coil 216 is coupled between the second coil 215 and the first feeding strip 105 and the ground 214.

There is a frequency separation between the first frequency band and the second frequency band i.e. in the implementation as illustrated in FIG. 2*b* the frequencies in the first antenna branch are lower than the frequencies in the second antenna branch. Circuit $\mathbf{103}_A$, according to this example, is dominantly inductive and is used to match the lower frequency band where the inherent impedance of the antenna element, i.e. CCE, is dominantly capacitive. Coils 212 and 215 together with the capacitor 213 result in a lowpass type frequency response. The additional coil 216 is used to adjust the CCE impedance at the first frequency band.

In the second matching circuit $\mathbf{103}_B$, as illustrated in FIG. 2*b*, the antenna input to the feeding point 101 is taken to the load 201 through two capacitors 222, 223 coupled in series, wherein a third capacitor 224 is coupled between the port 101 and the capacitor 222 and ground 214. Further, a coil 225 is coupled between the capacitors 222 and 223 and the ground 214.

Correspondingly, circuit $\mathbf{103}_B$ is dominantly capacitive to compensate for the inherently inductive impedance of the antenna element, i.e. CCE, at the second frequency band. Capacitors 222 and 223 together with the coil 225 form a high pass type frequency response. The additional capacitor 224 is used to adjust the CCE impedance at the second frequency band.

In order to achieve the frequency separation, and thus the frequency multiplexing, between the antenna branches by means of the matching circuits $\mathbf{103}_A$ and $\mathbf{103}_B$ the design shall advantageously follow the principles in which a lowpass frequency response of matching circuit is implemented for the first frequency band, a high-pass response of the matching circuit is arranged for the second frequency band and both branches are co-designed (i.e. suitable matching circuit topologies and component values are to be selected which result in good frequency isolation between the branches). Thus, the matching circuit $\mathbf{103}_A$ should be invisible to the high frequency signal fed to the antenna structure and matching circuit $\mathbf{103}_B$ should be invisible to the lower frequency signal fed from port 109. In order to realize this in practice, the matching circuits $\mathbf{103}_A$ and $\mathbf{103}_B$ have to be designed together to form one type of diplexer circuit in order to achieve the desired frequency multiplexing in the antenna. The term "invisible" shall be in this context understood so that from the port 101 point of view it seems that there does not exist circuit $\mathbf{103}_B$ at all in a signal sense, or at least the possible effect caused by the circuit $\mathbf{103}_B$ is not harmful for impedance matching seen from port 101, at the first frequency band. Similarly, from the port 101 point of view, it seems that there does not exist circuit $\mathbf{103}_A$ at all in a signal sense, or at least the possible effect caused by the circuit $\mathbf{103}_A$ is not harmful for impedance matching seen from port 101, at the second frequency band.

Figure 3A:
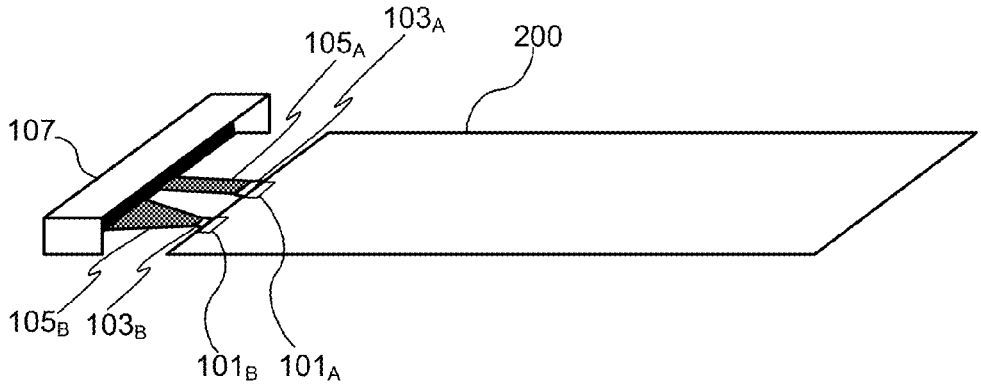
FIGS. 3*a* and 3*b* illustrate antenna structures according to second implementation of the invention.
Figure 3B:
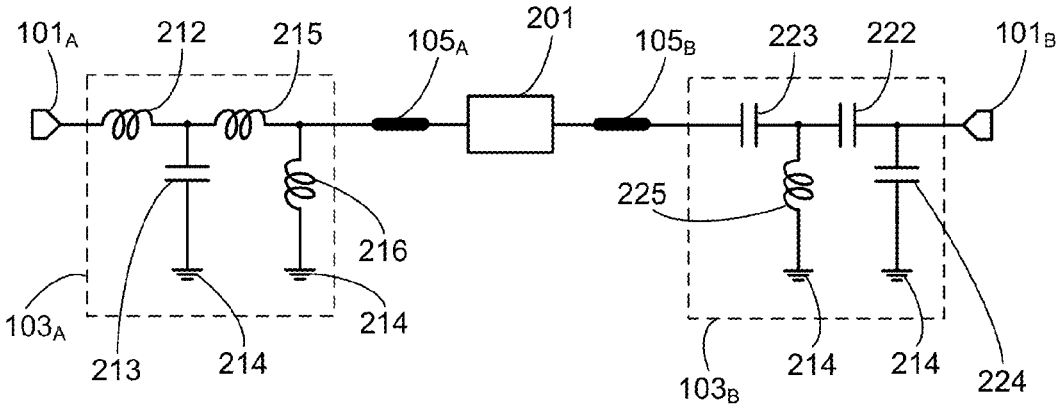

An embodiment of the antenna structure according to the invention is depicted in FIG. 3*a*. The antenna structure, according to this embodiment, comprises a dedicated feeding point for each of the feeding strips through matching circuits implemented in each of the antenna branches. In FIGS. 3*a* and 3*b* is shown an antenna structure with two branches for clarity reasons. The antenna structure consists of one antenna element 107 also called as coupling element. The antenna element may be so called capacitive coupling element (CCE), for example. The antenna element 107 is configured to receive and to transmit wireless radio frequency signals by cooperating with other elements of the antenna structure. The antenna structure comprises also a ground plane 200, which typically implemented on the PCB (Printed Circuit Board). According to the embodiment of the invention at least two feeding strips $\mathbf{105}_A$ and $\mathbf{105}_B$ are used for feeding the antenna element 107 and connected to the antenna element 107. Each of the feeding strips $\mathbf{105}_A$ and $\mathbf{105}_B$ comprises an own feeding point $\mathbf{101}_A$ and $\mathbf{101}_B$ respectively. At least some of the feeding points $\mathbf{101}_A$ and $\mathbf{101}_B$ may be directly connected to corresponding feeding strips $\mathbf{105}_A$ and $\mathbf{105}_B$. At least some other feeding points $\mathbf{101}_A$ and $\mathbf{101}_B$ may be connected to matching circuits implemented between the feeding point and the corresponding feeding strip. FIG. 3*a* also illustrates the matching circuits $\mathbf{103}_A$ and $\mathbf{103}_B$, which in this embodiment are implemented in every antenna branch. Additionally, it may be necessary to isolate the first feeding point $\mathbf{101}_A$ and the second feeding point $\mathbf{101}_B$ from each other so that the signal on the first frequency band fed to the first feeding point $\mathbf{101}_A$ does not have a path to the second feeding point $\mathbf{101}_B$ and vice versa. This can be implemented within the matching circuits and/or within the antenna geometry by careful design, or by using additional filtering elements. Further, if the antenna element is so called self-resonant antenna element, the matching may be achieved, especially as regards at least one antenna branch which is formed at least partly with a feeding strip, without a specific matching circuit $\mathbf{103}_A$, $\mathbf{103}_B$, but merely by modifying the antenna geometry in an optimal way for at least one branch. However, the frequency separation of the signals has to be realized between the branches also in this case with frequency-selective or switching components.

FIG. 3*b* illustrates examples of the matching circuits for the first feeding strip $\mathbf{105}_A$ and the second feeding strip $\mathbf{105}_B$. The combination of the antenna element 107 and the ground plane 200 are illustrated as a load 201 in FIG. 3*b* forming the radiating parts of the antenna structure.

FIGS. 2*b* and 3*b* illustrate examples of the matching circuits $\mathbf{103}_A$, $\mathbf{103}_B$ on an electrical component level. However, the implementations as shown are only examples and the implementation may be selected case-by-case basis. In the example circuits, the diplexing, i.e. the frequency multiplexing, function is embedded in the matching circuits. Thus, it can be said that the frequency multiplexing may be implemented with an equivalent isolation mechanism as long as these can be configured to separate the frequencies of the signal paths associated with each feeding strip and/or match the impedance of the signal paths for the needs.

The shapes of the feeding strips $\mathbf{105}_A$ and $\mathbf{105}_B$ can be selected for enabling the desired impedance bandwidth performance. In the embodiments as depicted in FIGS. 2*a* and 3*a* the first feeding strip $\mathbf{105}_A$ is narrow in shape, which has strong inductive behavior, and thus facilitates good impedance bandwidth for a CCE antenna at low frequencies and helps to reach some additional selectivity against higher frequencies. The second feeding strip $\mathbf{105}_B$, in turn, is wider with an opening angle by means of which it is possible to improve the potential of the antenna at higher frequencies. The first feeding strip $\mathbf{105}_A$ in FIGS. 2*a* and 3*a* is coupled along the center line of the long axis of the ground plane and the second feeding strip $\mathbf{105}_B$ is coupled offset from the center line. In the case of the embodiments, as described as examples of the invention, the location of the offset feeding strip with respect to the single antenna element is preferably selected so that it excites a natural resonance (i.e. a radiating resonant wavemode) of the antenna element and ground plane combination at the second frequency band. Meanwhile, the central located feeding strip does not cause this natural resonance i.e. resonant wavemode, or non-orthogonal wavemodes with respect to the resonant wavemode at frequencies close to the resonant wavemode frequency, to be excited. This results in some useful natural electromagnetic isolation between the matching branches. The careful design of the feeding strip locations thus assists in achieving optimal antenna performance as a whole. The invention is not anyhow limited to the shapes, locations and/or number of the feeding strips $\mathbf{105}_A$ and $\mathbf{105}_B$ as disclosed in FIG. 2*a*, 2*b*, 3*a* or 3*b*. The shapes, locations and the number of the feeding strips $\mathbf{105}_A$ and $\mathbf{105}_B$ are to be selected according to operational requirements of the antenna. For example, it is even possible to implement multiple similarly shaped feeding strips to the antenna structure as long as the frequency bands can be optimized according to the need. Generally speaking a feeding strip affects to the antenna impedance causing an amount of serial inductance and parallel capacitance to the antenna. The amounts of the mentioned parasitic reactances are dependent on the shape of the feeding strip. For example, if the feeding strip is narrow, it causes more serial inductance, and with a broader feeding strip it is possible to achieve more parallel capacitance in the antenna structure. Moreover, if the feeding strip is shaped so that it is narrower at the end coupled to the feeding point and broader at the end towards the antenna element, it is achieved less serial inductance and less parallel capacitance. Thus, in case of capacitive coupling element (CCE) as an antenna element it is needed inductive components, such as narrow feeding strip, for matching in low frequencies. In high frequencies, as the impedance of the CCE is slightly inductive, it is advantageous to use such a feeding strip for matching in which case both the serial inductance and parallel capacitance are low. As said, especially the locations, but also shapes of the feeding strips, need to be selected on the basis of the frequency bands into which the antenna element is to be matched.

Figure 4A:
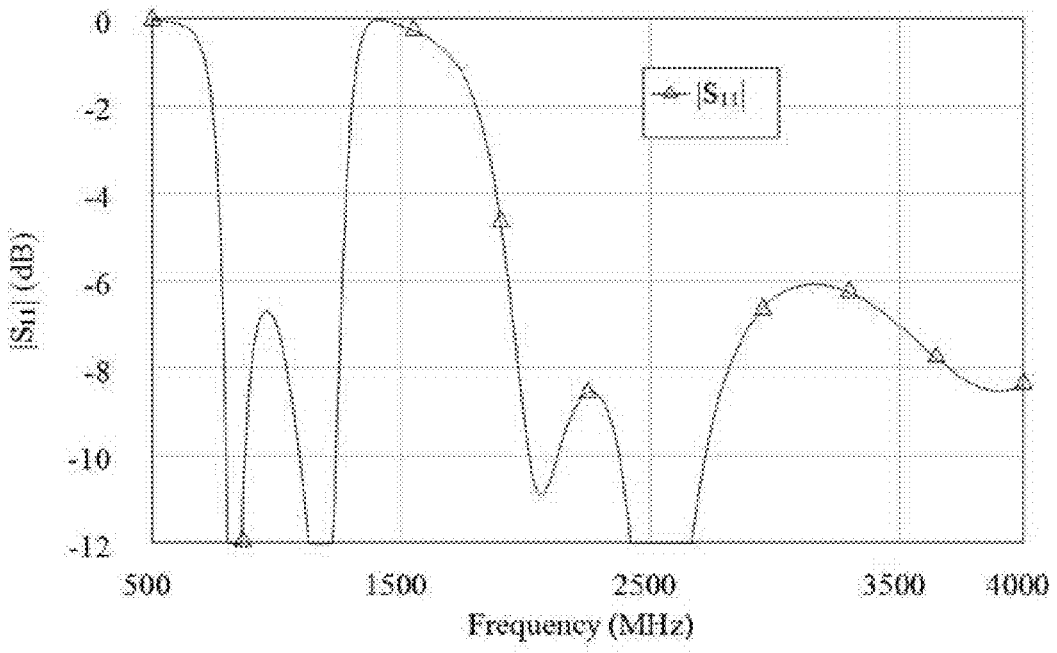
FIGS. 4*a* and 4*b* illustrate simulation results of the antenna structures according to the invention.
Figure 4B:
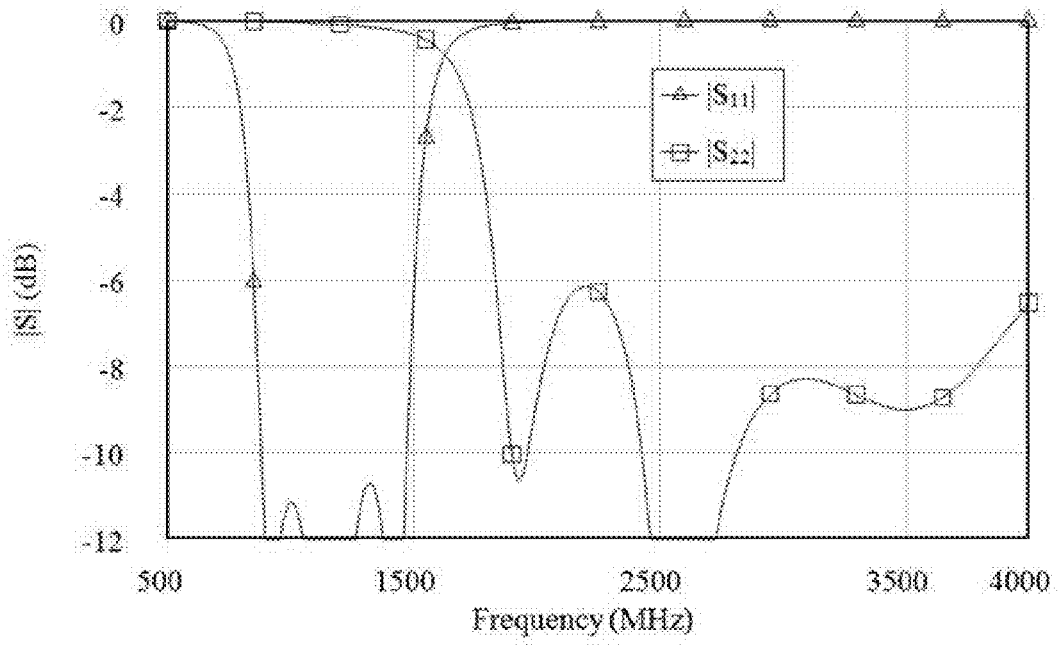

FIGS. 4*a* and 4*b* present a simulated impedance matching of prototype antennas corresponding to FIGS. 2*a* and 3*a* respectively. In FIG. 4*a* ideal matching reactances for the matching circuits as depicted in FIG. 2*b* were used. The impedance matching between the single feeding point 101 and the antenna element 201 is illustrated with $|S_{11}|$. It can be noticed that the single feeding point solution provides good impedance bandwidth results for the novel antenna structure in order to be applied for mobile communications.

Also in the simulation of the antenna structure of FIG. 3*a* the ideal matching reactances for the matching circuits as depicted in FIG. 3*b* were used. The simulation result can be seen in FIG. 4*b*. The impedance matching between the first feeding point $\mathbf{101}_A$ and the antenna element load 201 is illustrated with $|S_{11}|$ and the impedance matching with the second feeding point $\mathbf{101}_B$ and the antenna element load 201 is illustrated with $|S_{22}|$ in FIG. 4*b*. Both frequency bands meet so called 6 dB bandwidth criterion at the conventional frequency bands of mobile communications.

Figure 5:
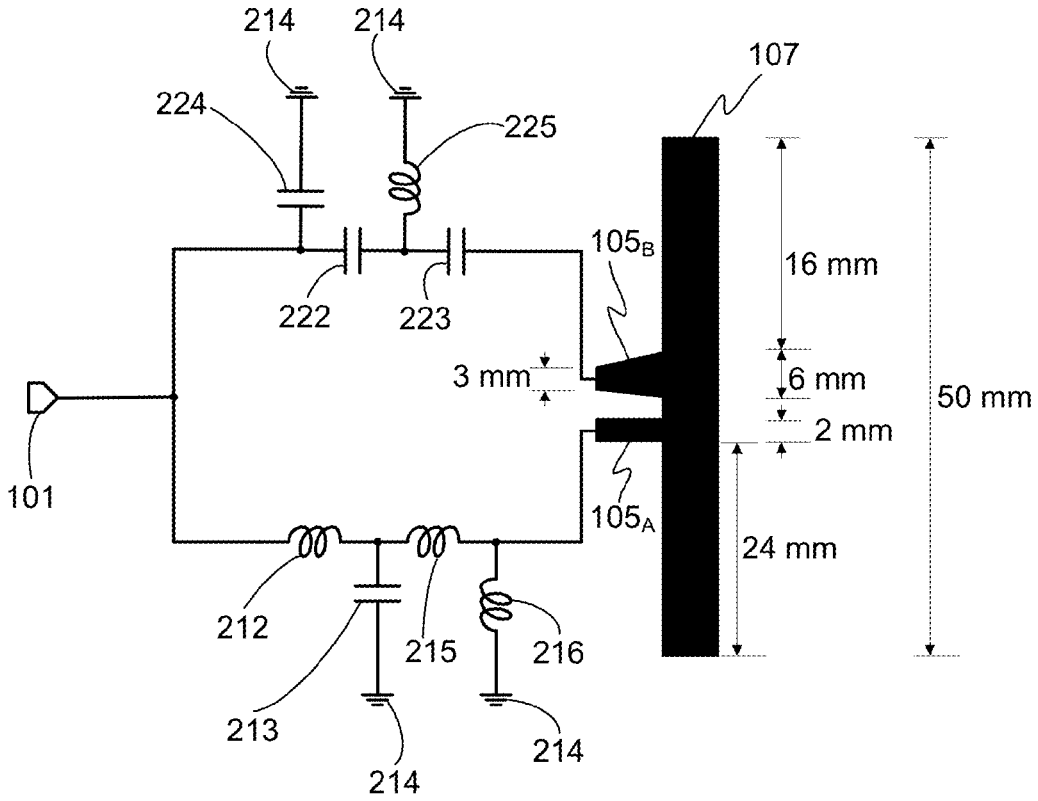
FIG. 5 illustrates an example of the multi-band antenna according to the invention.

FIG. 5 illustrates an example of the multi-band antenna of FIG. 2*a*, but also disclosing an example of the physical implementation, especially the sizes of the feeding strips $\mathbf{105}_A$ and $\mathbf{105}_B$ and the antenna element 107, as well as their relative locations. The width of the antenna element 107 in this example is 50 mm. The term 'width' refers to a dimension parallel to the long axis of the ground plane. The width of the first feeding strip $\mathbf{105}_A$ is 2 mm and the width of the wedge-shaped second feeding strip $\mathbf{105}_B$ is 3 mm at the end towards the feeding point 101 and 6 mm at the end coupled to the antenna element 107. The distance between the feeding strips is 2 mm. Furthermore, the other side of the first feeding strip $\mathbf{105}_A$ is, according to this exemplified implementation, 24 mm from the first end of the antenna element 107. The other side of the second feeding strip $\mathbf{105}_B$, in turn, is 16 mm from the second end of the antenna element 107. The distance of the antenna element 107 (the outer perimeter) from the ground plane 200, i.e. from the PCB, is 10 mm in this example (not illustrated in FIG. 5). The matching circuits performing also tasks of a multiplexer are configured to be implemented on the PCB.

Above it is mainly described implementations in which the antenna element 107 is capacitive coupling element CCE. The CCE is typically not matched well to the feeding and as a result a matching circuit is almost always needed. However, in some cases it may be achieved that CCE is matched well enough to some frequencies and in that case it may be possible that a matching circuit is not a necessity in all antenna branches. The frequency multiplexing of signals via the multiple branches is, however, needed in the one feeding point arrangement and thus, for example, a diplexer is to be implemented. As described above one or more matching circuits for one or more of the feeding strips may be implemented within the multiplexing circuit. If the antenna element is a so called self-resonant antenna element, such as PIFA, the matching is possible, at least partly, to arrange with antenna geometry. A multiplexer is also needed with self-resonant antenna element since without the multiplexer the antenna geometry unlikely provides enough isolation between the signal paths especially at wide frequency bands.

Generally speaking any traditional antenna element can also be applied within the inventive idea. For example, a microstrip patch and any of its derivatives, such as planar inverted-F antenna (PIFA), inverted-F antenna (IFA), planar inverted-L antenna (PILA) or inverted-L antenna (ILA) as well as loop antenna or monopole antenna, can be used.

The multi-band antenna as described herein may be implemented as a module structure, which can be mounted to any device as such. In such a case, the necessary interfaces are arranged for bringing the signals to be transmitted to the antenna module from the transceiver element of the device. More specifically, such an antenna module would comprise the antenna element, the at least two feeding strips and the frequency multiplexing circuit with necessary matching circuits. The antenna module is implemented on a substrate by means of which the antenna structure can be isolated from the environment. An external ground plane as well as at least one signal source for the antenna module is provided through one of the mentioned interface, e.g. through at least one signal port, so that the common RF ground in the device into which the antenna module is installed can be utilized and the signal can be fed to and received from the antenna structure. The number of the mentioned signal ports may depend on the selected implementation of the invention as described. In case of one single signal port, i.e. the feeding point, the structure of the antenna module differs slightly of the case of more than one signal ports, i.e. feeding points. The other features and embodiments of the invention as described in the context of the antenna element are directly applicable in the case of antenna module.

Typical area of utilization such an antenna module is mobile terminals, which are configured to operate in multiple frequencies. In such area of implementation a transceiver module is coupled to the antenna module through the mentioned interfaces i.e. signal ports. Additionally, for example the PCB defining the RF ground plane within the mobile terminal may be utilized in the antenna module as described.

Some advantageous embodiments according to the invention were described above. The invention is not limited to the embodiments described. The inventive idea can be applied in numerous ways within the scope defined by the claims attached hereto.

What is claimed is:

1. A multi-band antenna comprising:

a ground plane;

a single antenna element;

a frequency multiplexing circuit;

at least two feeding strips coupled between the frequency multiplexing circuit and the single antenna element; and at least one feeding point arranged between the ground plane and the frequency multiplexing circuit, wherein at least two distinct signal paths are formed between the at least one feeding point and the single antenna element through the frequency multiplexing circuit and the at least two feeding strips.

2. The multi-band antenna as claimed in claim 1, further comprising at least one matching circuit, the at least one matching circuit being configured to be coupled between the frequency multiplexing circuit and at least one of the at least two feeding strips.

3. The multi-band antenna as claimed in claim 1, further comprising at least one matching circuit embedded in the frequency multiplexing circuit, the matching circuit providing impedance matching of at least one feeding strip of the at least two feeding strips for a predetermined frequency band.

4. The multi-band antenna as claimed in claim 1, further comprising two matching circuits embedded in the frequency multiplexing circuit, each of the matching circuits providing impedance matching of each of the feeding strips for at least two predetermined frequency bands.

5. The multi-band antenna as claimed in claim 1, wherein the multiplexing circuit is at least one of the following: a diplexer, an RF switch, and an isolation implementation.

6. The multi-band antenna as claimed in claim 1, wherein the single antenna element is at least one of the following: a Capacitive Coupling Element, a Planar inverted-F antenna, an Inverted-F antenna, a Planar inverted-L antenna, an inverted-L antenna, a loop antenna, and a monopole antenna.

7. The multi-band antenna as claimed in claim 1, wherein the at least one feeding strip is configured to be located, with respect to the single antenna element and the ground plane, so that a resonant wavemode of the radiating structure formed by the single antenna element and the ground plane at a given frequency is excited, and wherein the at least one other feeding strip is configured to be located, with respect to the single antenna element and the ground plane, so that the resonant wavemode of the radiating structure or non-orthogonal wavemodes with respect to the resonant wavemode at frequencies close to the resonant wavemode frequency are not excited by the at least one other feeding strip.

8. A multi-band antenna comprising:

a ground plane;

a single antenna element;

a frequency multiplexing circuit; and at least two feeding strips, dedicated feeding points being arranged for each of the at least two feeding strips, each of the at least two feeding strips being coupled between the dedicated feeding point arranged for the feeding strip and the single antenna element, wherein at least two distinct signal paths are formed between the dedicated feeding points and the single antenna element through the frequency multiplexing circuit and the at least two feeding strips.

9. The multi-band antenna as claimed in claim 8, further comprising at least one matching circuit, the at least one matching circuit configured to be coupled between one dedicated feeding point and a corresponding feeding strip.

10. The multi-band antenna as claimed in claim 9, wherein the at least one matching circuit is configured to be embedded in the frequency multiplexing circuit.

11. The multi-band antenna as claimed in claim 10, wherein the single antenna element is at least one of the following: a Capacitive Coupling Element, a Planar inverted-F antenna, an Inverted-F antenna, a Planar inverted-L antenna, an inverted-L antenna, a loop antenna, and a monopole antenna.

12. A multi-band antenna module comprising:

a substrate;

a single antenna element mounted to the substrate;

a frequency multiplexing circuit disposed on the substrate;

at least two feeding strips disposed on the substrate and coupled between the frequency multiplexing circuit and the single antenna element; and at least one signal port arranged to the substrate, providing an interface for at least external ground plane and a signal source, in order to provide a signal to and from the antenna element through the frequency multiplexing circuit and the at least two feeding strips, wherein at least two distinct signal paths are formed between the at least one signal port and the single antenna element through the frequency multiplexing circuit and the at least two feeding strips.

13. The multi-band antenna module as claimed in claim 12, module further comprising at least one matching circuit disposed on the substrate, the at least one matching circuit being configured to be coupled between the frequency multiplexing circuit and at least one feeding strip.

14. The multi-band antenna module as claimed in claim 12, further comprising at least one matching circuit embedded in the frequency multiplexing circuit and disposed on the substrate, the matching circuit providing impedance matching of at least one feeding strip of the at least two feeding strips for a predetermined frequency band.

15. The multi-band antenna module as claimed in claim 12, further comprising two matching circuits embedded in the frequency multiplexing circuit and disposed on the substrate, each of the matching circuits providing impedance matching of each of the feeding strips for at least two predetermined frequency bands.

16. The multi-band antenna module as claimed in claim 12, wherein the multiplexing circuit disposed on the substrate is at least one of the following: a diplexer, an RF switch, and an isolation implementation.

17. The multi-band antenna module as claimed in claim 12, wherein the single antenna element mounted to the substrate is at least one of the following: a Capacitive Coupling Element, a Planar inverted-F antenna, an Inverted-F antenna, a Planar inverted-L antenna, an inverted-L antenna, a loop antenna, and a monopole antenna.

18. The multi-band antenna module as claimed in claim 12, wherein the at least one feeding strip is configured to be disposed on the substrate, with respect to the single antenna element, so that a resonant wavemode of the radiating structure formed at least partly by the single antenna element at a given frequency is excited, and wherein the at least one other feeding strip is configured to be disposed on the substrate, with respect to the single antenna element, so that the resonant wavemode of the radiating structure or non-orthogonal wavemodes with respect to the resonant wavemode at frequencies close to the resonant wavemode frequency are not excited by the at least one other feeding strip.

19. A multi-band antenna module comprising:

a substrate;

a single antenna element mounted to the substrate;

a frequency multiplexing circuit disposed on the substrate;

at least two feeding strips disposed on the substrate, dedicated signal ports, providing an interface to an external ground plane and at least one signal source, being arranged to the substrate for each of the at least two feeding strips, each of the at least two feeding strips being coupled between the dedicated signal port arranged for the feeding strip and the single antenna element, wherein at least two distinct signal paths are formed between the dedicated signal ports and the single antenna element through the frequency multiplexing circuit and the at least two feeding strips.

20. The multi-band antenna module as claimed in claim 19, further comprising at least one matching circuit disposed on the substrate, the at least one matching circuit being configured to be coupled between one dedicated signal port and a corresponding feeding strip.

21. The multi-band antenna module as claimed in claim 20, wherein the at least one matching circuit is configured to be embedded in the frequency multiplexing circuit.

22. The multi-band antenna module as claimed in claim 21, wherein the single antenna element mounted to the substrate is at least one of the following: a Capacitive Coupling Element, a Planar inverted-F antenna, an Inverted-F antenna, a Planar inverted-L antenna, an inverted-L antenna, a loop antenna, and a monopole antenna.

* * * * *